US006109481A

United States Patent [19]

Alexander et al.

[11] Patent Number: 6,109,481

[45] Date of Patent: Aug. 29, 2000

[54] POWDER ATOMIZER

[75] Inventors: George R. Alexander, Frankton; Eduardo C. Escallon, Elwood, both of Ind.

[73] Assignee: Material Sciences Corporation, Elk Grove Village, Ill.

[21] Appl. No.: 08/873,929

[22] Filed: Jun. 12, 1997

Related U.S. Application Data

[63] Continuation-in-part of application No. 08/680,243, Jul. 10, 1996, Pat. No. 5,769,276.

[51] Int. Cl.[7] ..... B67D 1/08

[52] U.S. Cl. ..... 222/148; 222/196; 222/216; 222/410; 222/630

[58] Field of Search ..... 222/139, 148, 222/158, 196, 216, 290, 311, 406, 407, 410, 414, 630, 637; 239/668

[56] References Cited

U.S. PATENT DOCUMENTS 3,299,853 1/1967 Whitacre ..... 118/312

5,314,090 5/1994 Alexander ..... 222/1

5,796,276 6/1998 Alexander ..... 222/148

FOREIGN PATENT DOCUMENTS 180010 10/1935 Switzerland .

*Primary Examiner*—Joseph A. Kaufman

*Attorney, Agent, or Firm*—Liniak, Berenato, Longacre & White, LLC

[57] ABSTRACT

A powder atomizer comprises a pan, and an element journaled for rotation about an axis. The pan partially surrounds the element, and therewith defines a venturi into which powder is fed. The venturi has an inlet and a spaced outlet. A motor rotates the element within the pan in excess of the speed required to throw powder from the element by centrifugal force and draws gas through the venturi, so that powder fed into the element is atomized and produces a uniform cloud of particulate material. A nonconductive element minimizes the electrical charge on the pan, and thereby the resulting agglomerization of particulate material at the outlet.

58 Claims, 6 Drawing Sheets

POWDER ATOMIZER

CROSS-REFERENCE TO RELATED APPLICATION

This is a Continuation In Part of application Ser. No. 08/680,243, filed Jul. 10, 1996 now U.S. Pat. No. 5,769,276.

BACKGROUND OF THE INVENTION

The present invention relates to devices used for delivering a measured volume of powder from a hopper to an air stream, and more particularly pertains to a powder atomizer which can be combined with a feeder deagglomerator to deliver measured amounts of atomized powder into an air stream in the form of a moving particulate cloud.

In the past powders have been atomized in a number of ways. Hoppers have been used to feed powders to flowing air streams. Hoppers, however have been unsatisfactory in feeding powder because of the bridging of the powder or the electrostatic forces which are present between the particulate of the powder. The rate of flow can also be affected by such variables as humidity, particle size, particle shape, density, material cohesiveness, chemical composition, hopper configuration and electrostatic forces between the particulate powder. Additional problems are encountered when precisely measured amounts of powder need to be dispensed, at instantaneously uniform rates of flow and when the powder dispensed tends to agglomerate.

Therefore it is highly desirable to provide an improved powder atomizer, an improved powder feeder atomizer combination and an improved powder feeder atomizer deagglomerator combination. It is also highly desirable to provide an improved powder atomizer, an improved powder feeder atomizer combination and an improved powder feeder atomizer deagglomerator combination which can deliver precisely measured amounts of powder to controllably uniform flowing air streams.

Hoppers even when supplemented with vibrators are notoriously non-uniform in metering powder in precisely measured amounts in coating operations. Additional problems are encountered with coating wide substrates when powder fed by a hopper is attempted to be atomized into a flowing air stream inasmuch as the air used to atomize the powder is more or less two dimensional, i.e., longitudinally and in one lateral dimension. For wide web applications, this air stream is generally planar and of relatively low velocity. As such it does not apply the locally high velocity shear forces required to deagglomerate the powder from the feeder, and consequently, the cloud may include over sized agglomerated particles and heavy streams of non-uniform particulate concentrations which are undesirable in many processes. It is therefore highly desirable to provide an improved powder atomizer and an improved powder atomizer feeder combination and an improved powder atomizer feeder deagglomerator combination for wide web coating operations which can produce clouds of relatively uniform sized deagglomerated particulate material which are relatively uniform both transversely and longitudinal of the web.

Recently, accurately measured amounts of powder material can be metered into air streams and atomized utilizing material feeders such as disclosed in U.S. Pat. No. 5,314,090, and the size of the particulate in the cloud can be made more uniform by utilizing a deagglomerator such as disclosed in U.S. Pat. No. 5,035,364. While the combination of such a material feeder and deagglomerator is capable of producing uniform particulate clouds being uniform both in particulate size and distribution and both transversely and longitudinally of the cloud, the combination does not produce uniform clouds of particulate material in wide web applications such as powder coating of coiled metal sheets, and conveyors with closely grouped articles to be coated. The grouping of a plurality of material feeders and deagglomerator combinations side by side produces a cloud which may be uniform in particulate size longitudinally of the cloud flow. However, non-uniformity is still present transversely of the cloud because of overlapping and streaking. It is therefore highly desirable to produce an improved powder atomizer and powder atomizer feeder combination and an improved powder feeder deagglomerator atomizer combination which is capable of producing clouds of particulate material which are relatively uniform both longitudinally and transversely of the cloud and which contain particulate material of relatively uniform particulate size relatively uniformly distributed throughout the cloud over large areas such as encountered in wide web coating applications.

Recently, the precise metering of accurate amounts of powder can be accomplished utilizing the material feeder disclosed in U.S. Pat. No. 5,314,090 by utilizing an elongated brush which has an axial length larger than the width of the web being coated. Utilizing such an apparatus, accurate amounts of powder may be fed but not atomized or completely deagglomerated. Webs may be horizontally disposed and the top or bottom or both may need to be coated or may be vertically disposed and one or both sides may need to be coated. It is therefore highly desirable to provide an improved powder atomizer, an improved powder feeder atomizer deagglomerator combination and an improved powder atomizer feeder combination for use in both horizontal and vertical powder coating applications which produces a particulate cloud which is highly uniform in both transverse and longitudinal directions and in particulate size and particulate size distribution. It is also highly desirable to provide an improved powder atomizer, improved powder atomizer feeder combination and an improved powder feeder atomizer deagglomerator combination which can be utilized to direct a particulate cloud which is uniform both in transverse and longitudinal directions and both in particle size and particle size distribution to both the upper side of horizontally disposed webs located below the atomizer and the underside of horizontally disposed webs located over the atomizer or to the opposite sides of vertically disposed webs.

To provide uniformity and versatility, it is also highly desirable to provide an improved powder atomizer and an improved powder atomizer feeder combination and an improved atomizer feeder deagglomerator combination for such uses in a variety of applications at a reasonable cost.

Finally it is highly desirable to provide an improved powder atomizer, an improved powder atomizer feeder combination, and an improved powder feeder atomizer deagglomerator combination which has all of the above desired features.

SUMMARY OF THE INVENTION

It is therefore an object of the invention to provide an improved powder atomizer, an improved powder feeder atomizer combination and an improved powder feeder atomizer deagglomerator combination.

It is also an object of the invention to provide an improved powder atomizer, an improved powder feeder atomizer combination and an improved powder feeder atomizer deagglomerator combination which can deliver precisely measured amounts of powder to uniformly controlled flowing air streams.

It is also an object of the invention to provide an improved powder atomizer and an improved powder atomizer feeder combination and an improved powder atomizer feeder deagglomerator combination for wide web coating operations which can produce clouds of relatively uniform sized deagglomerated particulate material in cross-sections which are relatively uniform both transversely and longitudinal of the web.

It is also an object of the invention to produce an improved powder atomizer and an improved powder feeder atomizer combination and an improved powder feeder, atomizer, deagglomerator combination which are capable of producing particulate clouds which are highly uniform in both transverse and longitudinal directions in both particulate size and particulate size distribution.

It is also an object of the invention to provide an improved powder feeder atomizer deagglomerator combination and an improved atomizer and an improved deagglomerator for use in both horizontal and vertical powder coating applications which produces a particulate cloud which is highly uniform in both transverse and longitudinal directions in both particulate size and particulate size distribution.

It is also an object of the invention to provide an improved powder atomizer, an improved powder feeder atomizer combination, and an improved powder feeder atomizer deagglomerator combination which can be utilized to direct a particulate cloud which is uniform both in transverse and longitudinal directions and both in particle size and particle size distribution to both the upper side of horizontally disposed webs located below the atomizer and the underside of horizontally disposed webs located over the atomizer or combination, or to the opposite sides of vertically disposed webs or parts arranged in a vertical display.

It is also an object of the invention to provide an improved powder atomizer and an improved powder atomizer feeder combination, and an improved powder atomizer feeder deagglomerator combination for such uses in a variety of applications at a reasonable cost.

It is finally an object of the invention to provide an improved powder atomizer and an improved powder atomizer feeder combination and an improved powder feeder atomizer deagglomerator combination which has all of the above desired features.

In the broader aspects of the invention there is provided an improved powder atomizer comprising a cylindrical pan, a cylindrical resiliently deformable element, which is journaled for rotation about an axis within the pan. The pan is mounted coaxially of the element. The element and pan define a cylindrically shaped venturi therebetween into which powder is fed. The venturi has an inlet and outlet radially spaced apart. Means is provided for rotating the element within the pan at speeds in excess of that required to throw the powder from the element by centrifugal force. The element draws ambient air through the venturi and atomizes and deagglomerates powder fed into the venturi inlet thereby forming a uniformly flowing cloud of particulate material which is uniform both longitudinally and laterally of said axis. The invention also provides an atomizer feeder and an atomizer feeder combination deagglomerator combination with a feeder such a disclosed in U.S. Pat. No. 5,314,090 which is particularly useful in wide web coating applications to produce a particulate cloud which is uniform both laterally and longitudinally of the web and uniform in both particulate distribution and particulate size throughout the uniformly flowing cloud.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
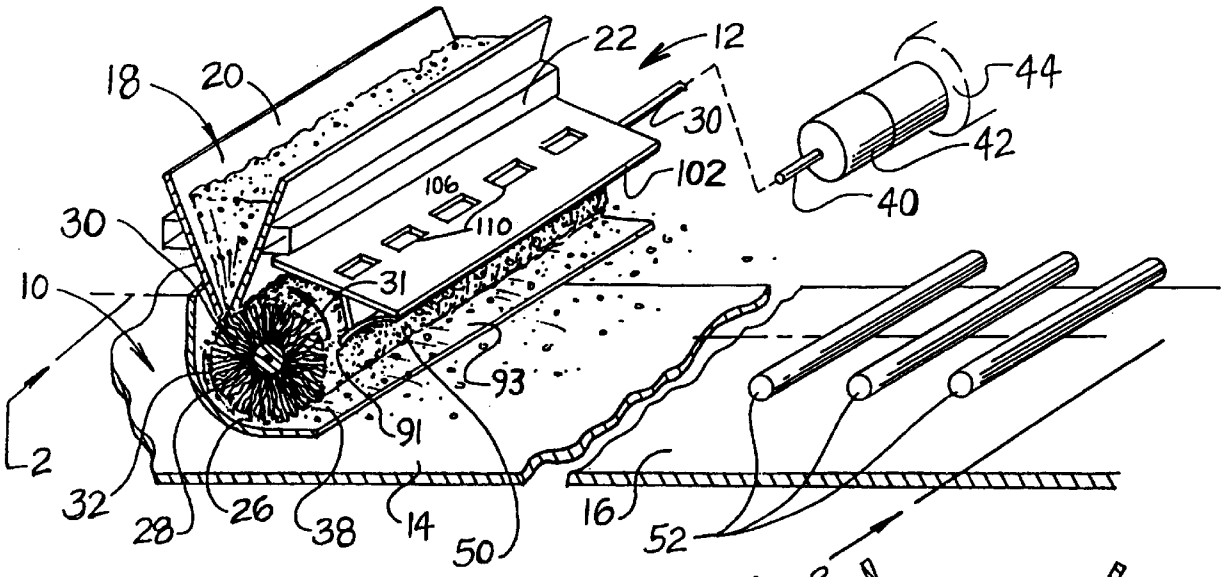
FIG. 1 is a perspective and fragmentary view of the improved atomizer of the invention mounted beneath a conventional hopper in a wide web top surface powder coating process with one end removed to facilitate viewing.
Figure 2:
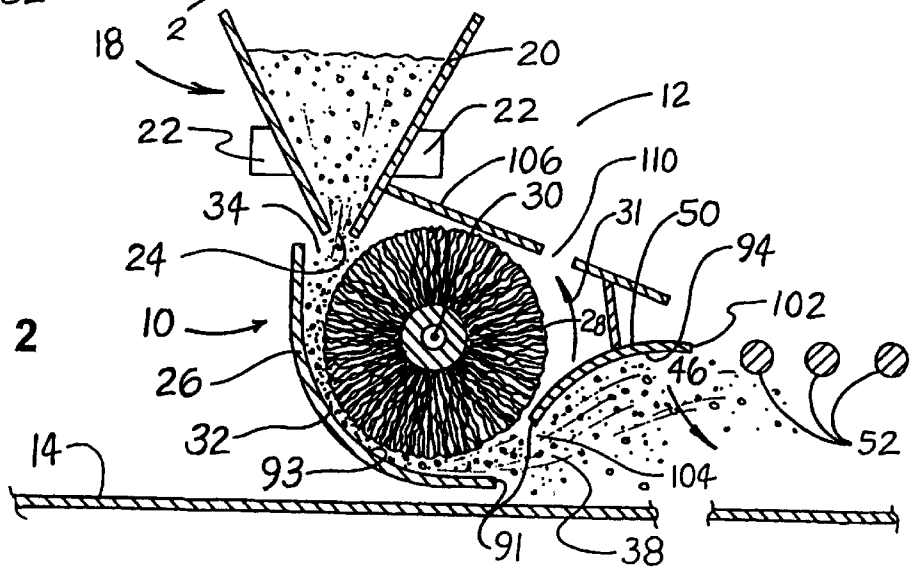
FIG. 2 is a cross-sectional view of the apparatus shown in FIG. 1 taken essentially along the section line 2—2 of FIG. 1.
Figure 5:
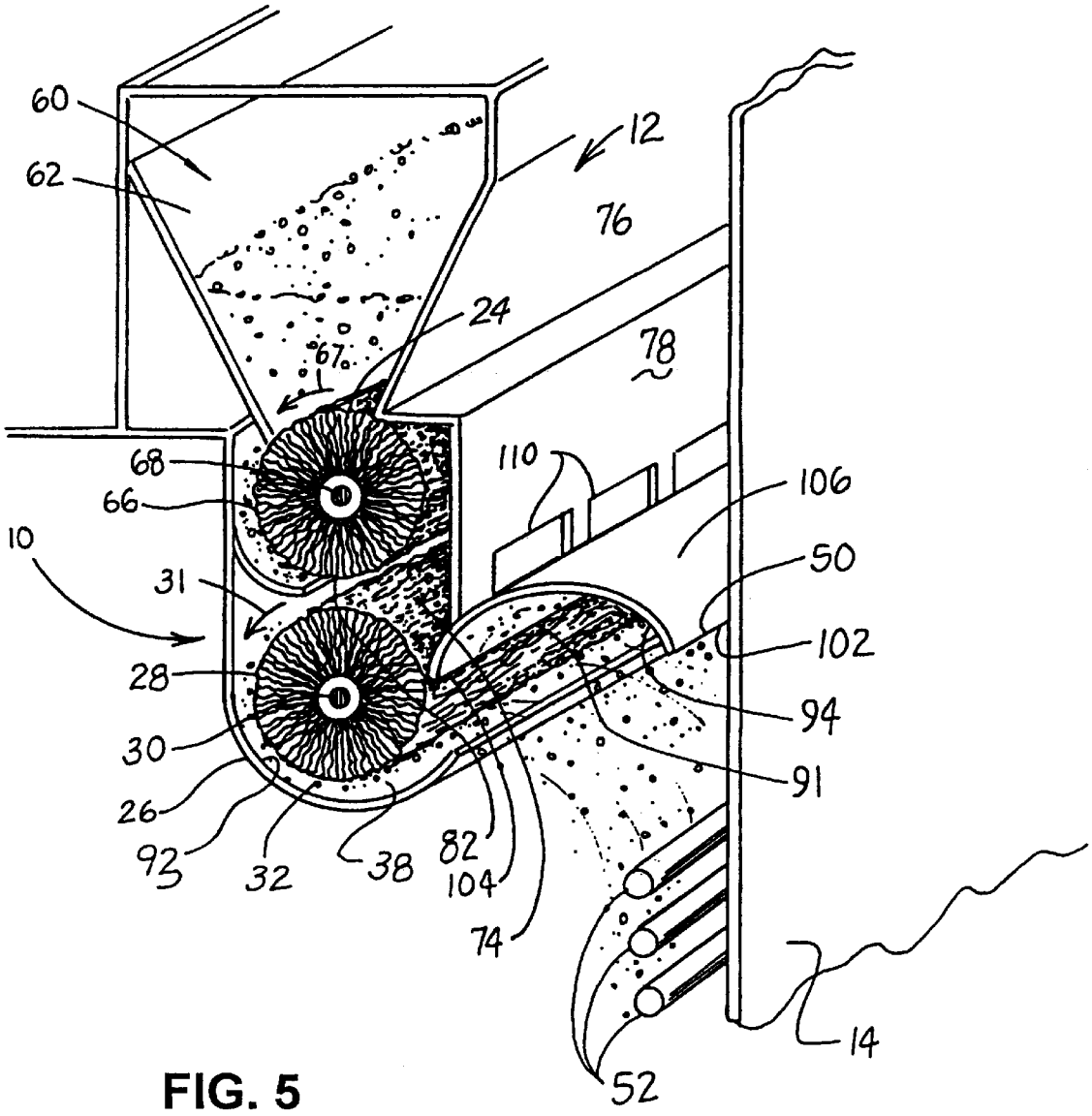
FIG. 5 is a perspective and fragmentary view of the improved atomizer of the invention like FIGS. 1 and 3, mounted beneath a powder feeder such as disclosed in U.S. Pat. No. 5,314,090 in a wide web left side powder coating process where the web or substrate is vertically transported.
Figure 6:
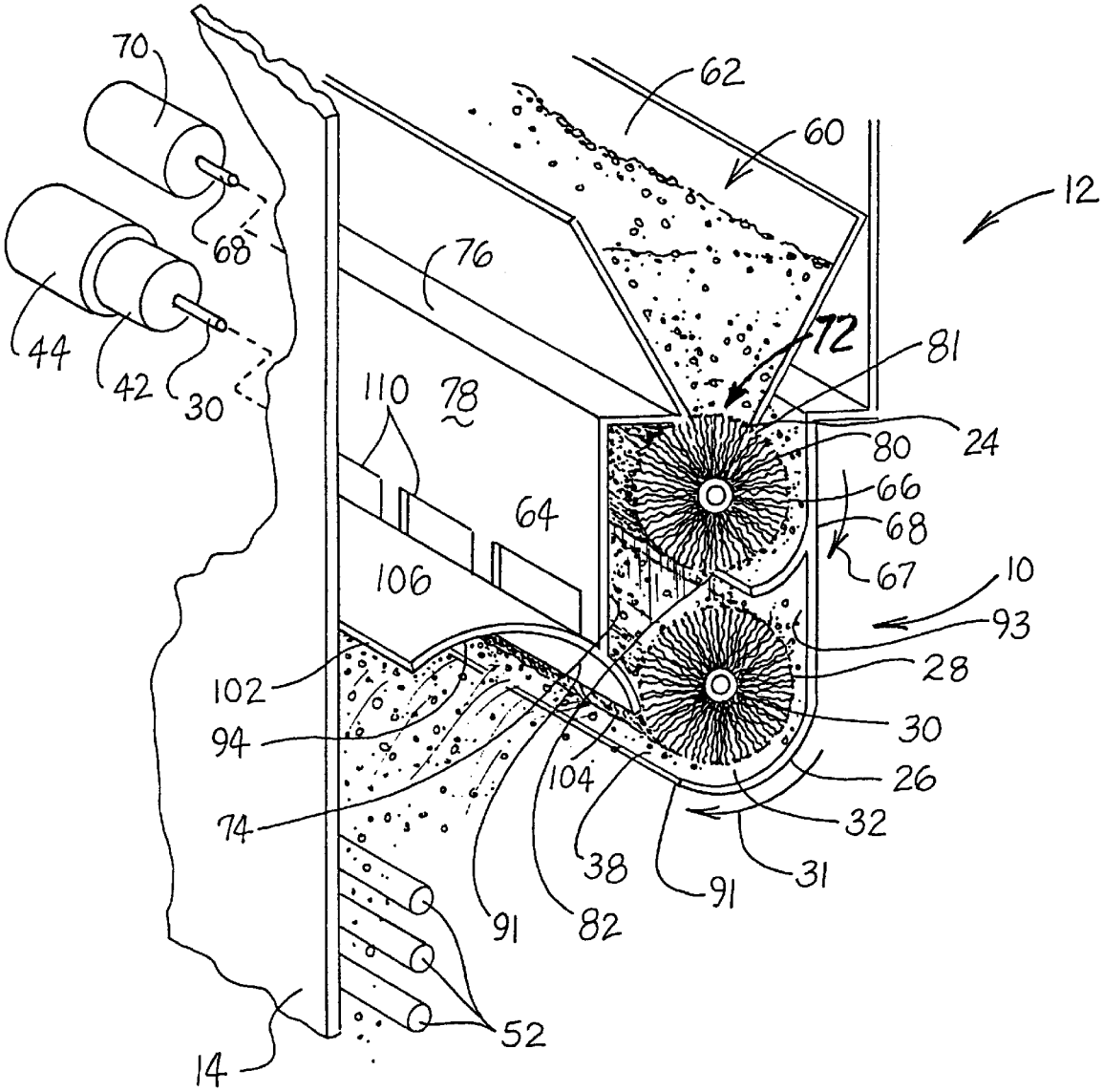
FIG. 6 is a perspective and fragmentary view like FIGS. 1, 3 and 5, of apparatus similar to that shown in FIG. 5 for coating the right side of the same web.

Referring to FIGS. 1 and 2, there is shown the improved powder atomizer 10 of the invention as a part of a wide web powder coating apparatus 12 mounted over a wide web substrate 14 for coating the top side 16 of the substrate 14. The apparatus 12 includes a powder feeder 18 and an atomizer 10. The powder feeder 18 is shown as a conventional powder hopper 20 which may be provided with a vibrator 22, if desired. Hopper 20 has a bottom opening 24 through which powder is dropped onto the atomizer 10 therebelow. In other specific embodiments, powder feeder 18 may be an elongated feeder such as disclosed in U.S. Pat. No. 5,314,090 as shown in FIGS. 5 and 6 and will be described in detail hereafter. The entire disclosure of the specification of U.S. Pat. No. 5,314,090 is incorporated herein as if it were transcribed herein word by word.

The powder atomizer 10 is shown to comprise a pan 26, a wing 50 and a generally cylindrical atomizing element 28 journaled for rotation about a generally horizontal axis 30 in the direction of arrow 31. Pan 26 is also generally cylindrical in shape. Pan 26 and element 28 are mounted coaxially of each other. Pan 26 partially surrounds element 28. Element 28 and pan 26 are spaced apart so as to define a cylindrical venturi 32 therebetween into which powder is fed from the feeder 18. Venturi 32 has an inlet 34 directly below the exit opening 24 of the feeder 18. Venturi 32 also has an outlet 38 radially spaced from the inlet 34 of the atomizer.

Wing 50 is mounted adjacent the brush 28 and extends from venturi outlet 38 toward the region to which the agglomerated particulate cloud is to be directed.

The hopper 20, the pan 26, atomizing element 28, venturi 32, inlet 34, outlet 38 and wing 50 may be all elongated so as to extend over the entire width or transverse dimension of the substrate 14, what ever the transverse dimension may be. In specific embodiments, this transverse dimension has been over 6 feet. No reason is known why this transverse dimension could not be tens of feet or match the transverse dimension of the largest substrate that can be handled, in a specific embodiment.

The atomizer element 28 is secured to motor shaft 40 through transmission 42 and operatively connected to motor 44. Motor 44 and transmission 42 rotate shaft 40 and element 28 in the direction of arrow 31 at a speed in excess of the speed required to throw powder from the element by centrifugal force. The speed of the element 28 draws air through the venturi 32 at a significantly fast rate of speed to disburse the powder into air, to mix the air and powder into a homogeneous mixture, and to deagglomerate the particles by particle to bristle and particle to wall collision to produce particles of relatively uniform size.

The speed of element 28 also may charge the particles of the resultant homogeneous cloud, each with a charge of the same polarity. By choosing the bristle material of element 28 to be nonconductive and the particulate material to be nonconductive, a charge of similar polarity can be placed on each of the particles of the particular cloud as it leaves the atomizer of the invention by the process commonly known as the triboelectrification effect. This particulate charge is useful inasmuch as it assists in the dispersion of the uniform cloud, both longitudinally and laterally thereof as it leaves the atomizer of the invention. This charge also expands the target area over which the cloud is completely uniform in particle size distribution, particle size and particle density.

This triboelectrification effect also has its drawbacks when pan 26 and wing 50 are made of conductive materials as the electrical charge on the particles induces an opposite electrical charge on the pan 26 and the wing 50 such that the particulate is attracted to the pan 26 and the wing 50 and in time produces agglomerates thereon. Depending on the conductivity of the particulate material, the particulate may accumulate and agglomerate on the tip 91 of the pan 26 or the wing 50 to an extent that the agglomerated particulate material may fall off either tip 91 onto the substrate below being coated. Generally, such agglomeration cannot be tolerated when coating the top surface of a web, as that particulate material which agglomerates sooner or later will fall off onto the surface being coated causing imperfections in the coated surface.

Agglomeration at the tips 91 can be minimized by manufacturing the pan 26 and the wing 50 of nonconductive material. However, at times, the pan 26 and wing 50 are desirably made of conductive material as will be mentioned hereinafter.

In the specific embodiment illustrated in FIGS. 1 and 2, the pan 26 and wing 50 are made of nonconductive material. In a specific embodiment, this nonconductive material is materials such as polycarbonate, acrylic, or acetal materials. In this specific embodiment, powder does not agglomerate thereon and pan 26 and wing 50 do not become charged by induction sufficiently for agglomeration of powder to occur thereon. Experiments indicate that any material having a conductivity in the range of about $10^{10}$ to about $10^{16}$ would be deemed a nonconductive material within the scope of this invention.

In another specific embodiment such as in FIGS. 1 and 2 illustrated, pan 26 and wing 50 are made of conductive materials such as metal because of both the structural strength required in the pan 26 and the surfaces 93, 94 required. In a specific embodiment, surface 93 is free from inconsistencies and polished to about a 125 rms. surface. Similarly, wing surface 94 is polished to about a 125 rms. surface.

Figure 10:
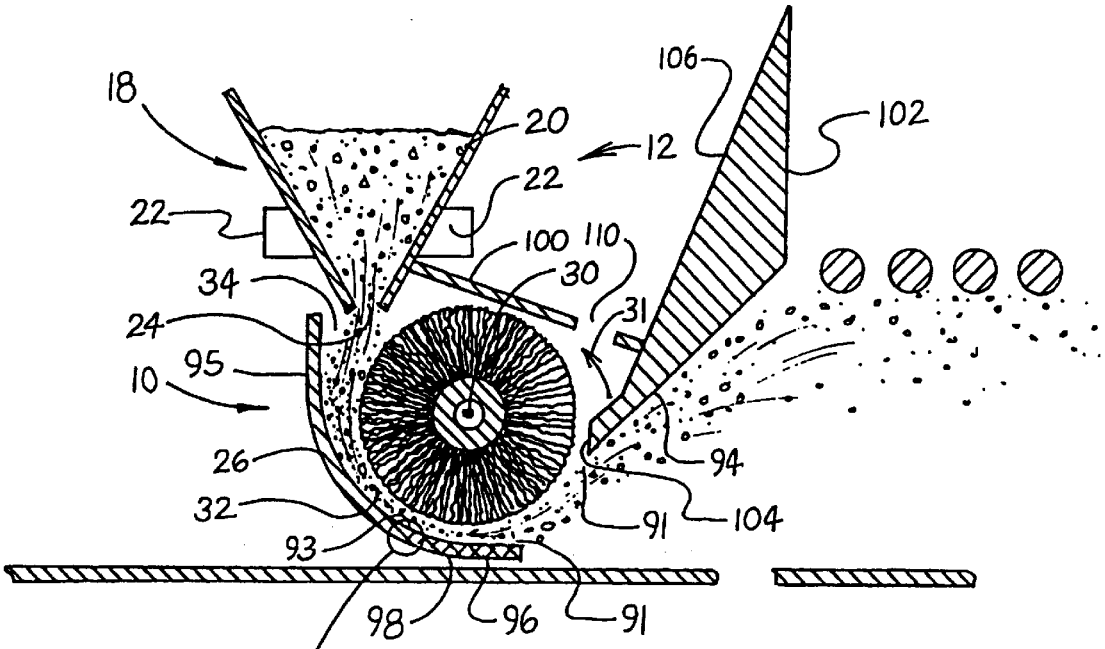
FIG. 10 is a fragmentary cross-sectional view like FIG. 2 of still another version of the improved atomizer of the invention mounted top surface powder coating process with one end removed to facilitate viewing.

In the specific embodiment illustrated in FIG. 10, pan 26 for the most part is made of conductive metal such as stainless steel for strength and durability and tip 91 is made of nonconductive material such as polycarbonate, acrylic, acetal or polyethylene as structural strength is provided by the metal of portion 95. Thus, pan 26 has a conductive portion 95 and a nonconductive portion 96. Nonconductive portion 96 extends from tip 91 away from tip 91 to at least the lowest point 98 on pan 26 as shown. Portions 95, 96 may be joined together in any fashion known to the prior art. FIG. 10 shows pan portions 95 and 96 being joined with a tongue and groove 99 such that pan portion 96 can be inserted at the end of pan portion 94 and slid into position. In this fashion, surface 92 of pan 26 can be made continuous. In a specific embodiment, surface 92 is polished to about a 125 rms. surface.

Wing 50 has an aerodynamic surface 94 extending from element 28 outwardly thereof, an end surface 102 remote from element 28, a near end surface 104 closely spaced to element 28 and a backside surface 106. As shown in FIGS. 1 and 10, aerodynamic surface 94 can either be curved or planar. Surface 94 is positioned closely adjacent to element 28 and extends outwardly away from element 28 to direct the cloud outwardly away from the cloud emanating from venturi outlet 38. End 104 may be planar or curved as shown in FIGS. 1 and 10. In FIG. 10 end surface 104 is curved with a slightly greater radius than element 28 and is cylindrical in shape. Both backside surface 106 and opposite end surface 102 may be planar or curved as desired. In a specific embodiment shown in FIG. 10, each of these surfaces are planar and have an angle of repose designed to prevent powder build up thereon, and recycle or direct powder collecting thereon away from the surface being coated. Powder is kept from accumulating on surface 94 by both the lack of induced charge and the velocity of air moving pass the surface 94. End surface 102 on the other hand has little air moving past its surface. Thus, surface 102 has an angle with respect to the horizontal in most embodiments from about 80° to about 100°. In most applications, the powder angle of repose is 80°. Backside surface 106, like surface 102, has little air flowing against the surface. Thus, backside—surface 106 will collect powder thereon if the angle of repose is not maximized. However, the powder collecting on backside surface 106 if angled with respect to the horizontal greater than the angle of repose for the powder always will be recycled after it collects on the surface by falling towards surface 104 and into the spinning element 28. In a specific embodiment, surface 106 has an angle with respect to the horizontal from about 45° to about 70° with the horizontal.

Referring to FIGS. 1 and 2, surface 94 is shown to be curved. Surface 102 extends from the curved surface generally perpendicularly thereof. Backside surfaces 106 extends from the hopper 18 to the wing 50 in a slope with recycle openings 110 therein. FIGS. 3, 4, 5 and 6 similarly have surface 94, backside surfaces 106 and generally perpendicular surfaces 78 as shown. Recycle openings 110 are positioned in surface 78 as shown.

The element 28 functions both as a blower rotor with pan 26 to direct air and powder entrained therein through venturi 32 and as a powder carrier as disclosed in U.S. Pat. No. 5,314,090.

The speed of rotation of the element 28 and the spacing of the element 28 from the pan 26 have a relationship which both moves the required air through the venturi 28 sufficiently fast to atomize the powder being fed into venturi inlet 34 and uniformly disperses the powder into a cloud exiting from the venturi outlet 38. In specific embodiments, the atomizer outlet 28 is a brush such as disclosed in U.S. Pat. No. 5,314,090.

Brush 28 can be any cylindrical element having a hub and radially extending bristles of any type. The bristles may be densely packed or spaced apart, arranged in a pattern or randomly arranged, long or short, thin or thick, relatively rigid or relatively flexible, and made of materials ranging from metals to plastics to natural filaments. The diametral size of the hub and the length of the bristles can also vary. The choice of bristles depends upon the function of the brush and the powder type being atomized.

If the atomizer is being used to disperse large amounts of powder into a small amount of air, the brush may have to carry some powder between the bristles before atomization. In these instances, the bristle length should be longer than usual to increase the powder carrying capacity of the brush between the bristles.

When the powder used tends to agglomerate or not flow readily in the atomizer, flexible bristles have the advantage inasmuch as flexing of the bristles will assist in adding motion and deagglomerating the powder.

If particulate size reduction is desired, a brush with stiff bristles is required. The length and material of the bristles will determine the length of life of the brush in any particular application.

The charge on the individual particles of the particulate cloud leaving the atomizer 10 of the invention will generally increase upon an increase in speed of rotation of the element 28, upon a decrease of the conductivity of the bristle material, and upon a decrease of the conductivity of the particulate material. In most applications, the performance of the brush element 28 can also be altered and finally adjusted by varying the speed at which the atomizer element 28 is rotated.

In specific embodiments in which deagglomeration and particle size reduction are required, brush 28 is chosen with bristles of specific materials, having a particular transverse diameter and a particular longitudinal length. Bristles may be circular in cross-section or rectangular in cross-section. When rectangular in cross-section, the resilient flexibility of the bristle in the direction of rotation and the direction transverse thereto can be varied. Such is important as both deagglomeration and particle reduction is believed to be dependent upon particle to bristle collisions in which the bristle impacts upon the particle and then is moved aside, transversely of the direction of motion, to allow the particle to impact upon another bristle. Thus, the more densely packed the bristles, the more particle to bristle collisions occur. The length to transverse dimension in the direction of the rotation ratio and the rotational speed of the brush determines the magnitude of the impact between the particle and the bristle. The length to the dimension transverse of the direction of rotation ratio and the density of the bristles and the rotational speed of the brush determines the number of impacts between the particles and the bristles that will occur.

In specific embodiments, bristles may include natural bristles, synthetic polymer bristles and metallic bristles. The bristle lengths range from relatively short to extremely long bristles. The bristle transverse dimensions range from about 2 to 3 times the size of the particles being atomized to transverse dimensions of fifty (50) times the largest transverse dimension of the particles being atomized. This in a practical sense limits the bristles to those having the largest transverse dimension from about 4 to about 15,000 microns, and length from a few inches to a number of feet.

Whereas the effect of the longitudinal length to transverse dimension of the bristles ratio on the particle size reduction and deagglomeration ability of the element 28 is well established, the overall diameter of the brush 28 seems to have less effect on the deagglomeration and the particle size reduction. By choosing elements 28 of larger diameters, the longitudinal length of the venturi in the direction of the air flow is increased, and thus the number of collisions between particles and bristles are increased. However, the impact force between the bristles and the particles colliding is determined by the hardness of the bristle and the longitudinal length and the transverse dimension ratio of the bristle as above-mentioned. Thus increasing the diameter of the element 28 and maintaining the same length to transverse dimension ratio of the bristles merely increases the number of particle collisions, not the type of collisions occurring. Thus, the focus in most applications is on the length to transverse dimension ratio of the bristles and the bristle material properties, rather than the diameter of the brush 28.

In specific embodiments, however, the length to transverse dimension ratio of the bristles varies from about 200 to 1 to about 800 to 1, the bristle length varies from about one half inch to about 5 inches, the bristle transverse dimensions in the direction of rotation range from about 0.001 inch to about 0.062 inch, the bristle transverse dimensions in directions transverse to the direction of rotation range from about 0.001 inch to about 0.062 inch, and the bristle length to transverse dimension ratio ranges from about 200 to 1 to about 800 to 1.

In specific embodiments, the pan 26 and the element 28 and the wing 50 may be elongated for wide web coating processes or may have length to diameter of element 28 ratios of less than 1, as desired. In specific embodiments, the thickness of the venturi or the distance between the element 28 and the pan 26 is from about 0.001 to about 0.100 inch and the element 28 is driven at speeds from about 700 to about 4,000 RPM depending upon the diametral size of the rotor and the rate in pounds per minute that powder is desirably atomized by the improved atomizer of the invention. Additionally in those embodiments, the element 28 is spaced from pan ends which are removed from the figures to enhance the view of the rotor element 28 and the venturi 32 and is spaced from the wing 50 a distance of from about 0.001 to about 0.020 inch. In these specific embodiments, powder having a particulate size from about 2 to about 300 microns may be atomized into a uniform cloud of particulate material having a relatively uniform particulate size uniformly distributed throughout the cloud in both the direction of flow and directions transverse thereof.

The hopper 20 may be any conventional hopper for use with powdered material. Hopper 20 may be geometrical as shown in FIGS. 1 and 2 or may be asymmetrical having for example a vertical wall and a wall angular to both the vertical and horizontal. It is highly preferable that the walls of the hopper 20 both have an angle with the horizontal greater than the angle of repose with respect to both the material of the hopper walls and the powder material being fed. The hopper 20 is mounted independently of the powder atomizer 10 and may be mounted on springs (not shown) and provided with a vibrator 22 as above mentioned.

Bottom opening 24 of hopper 20 is shown to be located over venturi inlet 32. Venturi inlet 32 in a specific embodiment may be converging so as to capture essentially all of the powder dropping from the hopper 20 into the atomizer 10. The outlet 38 of the venturi 32 and wing 50 are directed and aimed to deliver a flowing cloud of particulate material homogeneously dispersed throughout its air volume into the area of entrance 46 of a conventional electrostatic coater 48. The directing or aiming of the cloud toward the target is accomplished by utilizing the wing 50 and conventional gas flow techniques of the Coanda effect. Wing 50 may also serve the purpose of enclosing the upper region atomizer element so as to maintain the atmosphere around the atomizer as dust free as possible.

Totally surprisingly, the cloud leaving venturi outlet 38 is not thrown from the rapidly spinning element 28 as one would expect. In stark contrast, the homogeneous cloud of aspirated particulate material appears to follow the arcuate surface of the element 28 circumferentially around the element at least for 90° to as much as 360°. Thus, it is necessary to provide a wing to strip the cloud from following the element 28.

The wing functions to not only strip the cloud from the element 28, but also to direct the cloud as desired towards a desired region. Thus, in all embodiments, the leading edge of the wing needs to be virtually adjacent to the circumference of the element 28. In practical experience, element 28 appears to function well being spaced from the brush distances generally as close as possible.

A totally surprising event in the operation of the atomizer 10 is that the area between the powder atomizer 10 and the coating machine 48 need not be totally enclosed as the particulate cloud emanating from the venturi will generally follow first the arcuate path of the rotation of the element 28 and then the second the surface of the wing 94 and will not disperse throughout the room surrounding the atomizer in an uncontrolled condition as experienced with other powder atomizer designs . The atomizer 10 appears to impart a significant velocity to the cloud such that the Coanda effect dominates the effect that substantially stagnant ambient air has on the particulate cloud.

Once the cloud is directed into the area of the entrance 46 of an electrostatic coating machine 48 the cloud will be under the influence of the electrical field and ionization of the electrodes 52 of the coating machine and the flow of the carrier gas of the cloud through the coating machine 48. In a specific embodiment, coating machine 48 can be any on of those disclosed in U.S. Pat. No. 5,279,863, the disclosure of the specification of which is incorporated herein by reference as if it were reproduced herein word by word.

In a specific embodiment, the wing 50 may be secured to either the hopper 20 and vibrated therewith so as to minimize the accumulation of powder thereon, or independently supported or secured to the pan 26.

Figure 3:
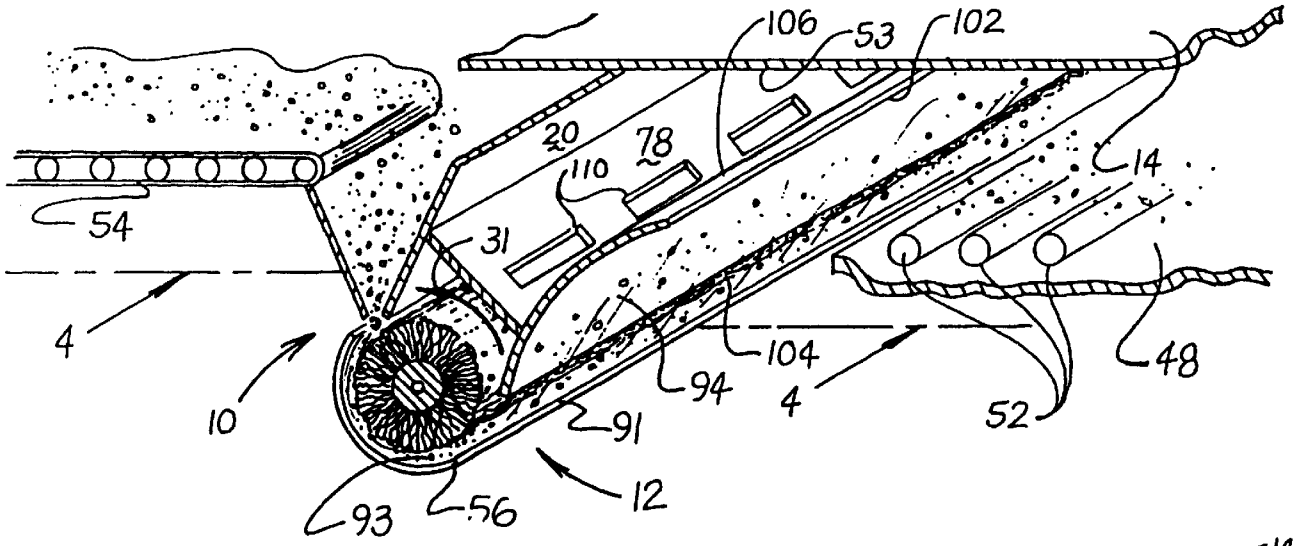
FIG. 3 is a perspective and fragmentary view of the improved atomizer of the invention like FIG. 1, mounted below a conventional hopper feeder in a wide web bottom surface powder coating apparatus.
Figure 4:
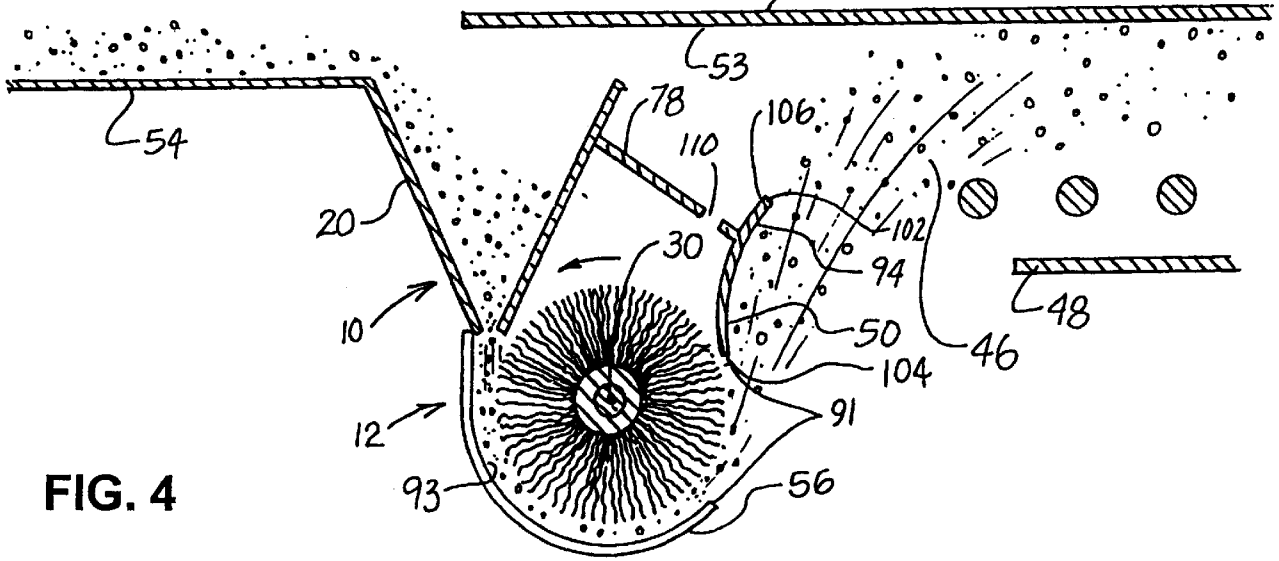
FIG. 4 is a cross-sectional view of the apparatus illustrated in FIG. 3 taken essentially along the section line 4—4 of FIG. 3.

Referring to FIGS. 3 and 4, there is shown an atomizer 10 and a apparatus 12 for use in coating the bottom side 53 of a substrate 14. The powder feeder 18 is also in the form of a hopper 20. In FIGS. 3 and 4 the hopper 20 is shown without the vibrator 22 and with a conveyance device 54 operatively positioned with regard to the hopper 20 to maintain the hopper 20 full of powder. Similarly, in other embodiments, the embodiment of FIGS. 1 and 2 may be provided with a conveyor 54 and used with or without vibrator 22. The speed at which the conveyor 54 is run must be coordinated with the speed with which the atomizer 10 is run such that continuous and adequate powder flow from the conveyor 54 through the hopper 20 and through the atomizer 10 and into the coating apparatus 48 is maintained.

In this embodiment, the hopper 20 and the atomizer 10 may be identical as above described. However, the wing 50 is positioned adjacent the exit 38 so as to span between the pan 26 to the area of entrance 46 of the coating machine 48. The wing 50 may be both shaped and positioned in accordance with conventional gas flow technology. The cloud of particulate material homogeneously disbursed throughout is stripped from the element 28 and fed into the entrance 46 of the coating machine 48 at which time the cloud will be under the influence of the electrical field of the machine 48, the movement of the cloud through the machine 48 is also controlled by the machine exhaust and gravity as is conventional.

Surprisingly, very little powder was not deagglomerated by the atomizer to a powder size in which the powder would be fully air borne. Essentially all of the powder fed to the atomizer 10 by the powder feeder 18 was fully deagglomerated to a desired particulate size and atomized and essentially no powder was not air borne and exited through the powder drain 56 at the lower edge thereof. Thus in most embodiments, powder drain 56 to remove large size particles which cannot be maintained air borne in the cloud exiting from the atomizer 10 is believed to be unnecessary and superfluous as regards to the atomizer 10 structure.

In all applications, the substrate 14 is moved via conveyor techniques relative to the atomizer 10, powder feeder 18 and coating machine 48. The direction of travel of the substrate i.e. whether the bare substrate is moved away from the atomizer 10 or toward the atomizer 10 depends upon the coating process. As with other electrostatic coating processes, it may be more desirable to impact the bare substrate 14 with the more concentrated cloud directly emanating from the atomizer 10 of the invention. In other coating processes, it may be advantageous to have the powder concentration of the cloud increase as the coated substrate 14 approaches the atomizer 10.

There is generally no concern as to the conductivity of the pan 20 and the wing 50 in the embodiment illustrated in FIGS. 3 and 4 as the embodiment is shown adapted for coating the bottom surface of a substrate. Since all of the apparatus is located below the surface to be coated, any agglomeration failing off the apparatus would not affect the surface coating.

Referring to FIGS. 5 and 6, the hopper 20 is shown substituted with the powder feeder 60 disclosed in U.S. Pat. No. 5,314,090. The powder feeder 60 of this patent as shown is able to feed reproducibly and accurately metered amounts of powder to the atomizer 10 of the invention. Thus, the powder feeder 60 may be used where control of the powder fed to the atomizer is more critical to the process and more control is required than possible utilizing a hopper 20 as above described.

Powder feeder 60 is fed by a hopper 62 which functions as a powder reservoir for the powder feeder 60. The hopper 62 may in a specific embodiment, be identical to the hopper 20 and be equipped with or used without a vibrator 22. As shown the hopper 62 has a bottom opening 24 which empties into a housing 64 in which a resiliently deformable element or brush 66 is journaled for rotation in the direction of arrow 67. Element 66 is secured to a shaft 68 which is journaled in opposite walls (not shown) of the housing 64. One end of the shaft 68 is connected to a variable speed motor 70. Housing 64 has a ventral portion 72, a bottom portion 74, a top portion 76, and a pair of side portions 78. Housing 64 fully encloses element 66.

Element 66 is generally cylindrical. Housing 64 can be made of plastic or any other suitable non-conductive material. Other embodiments have housing 64 made of transparent plastic material or having an access door in housing 64 (not shown) so that during operations observations and adjustments can be made. Element 66 is positioned in housing 64 so as to occlude hopper opening 24.

In most specific embodiments, element 66 is preferably a brush having a plurality of bristles 80 arranged with uniform density around hub 81 to extend radially therefrom. Bristles 80 can be naturally occurring filaments or filaments of any suitable material so that brush 66 is capable of "holding back" powder from flowing from hopper 20 through bottom opening 24. Bristles 80 must be of a suitable length and dimension where upon a selected speed of rotation, brush 66 permits powder from the hopper 20 to penetrate bristles 80 in a precise fashion, be carried by the brush 66 as it rotates, and to be delivered in a measured amount through exit port 82 in bottom 74 to the atomizer 10 of the invention. As disclosed in U.S. Pat. No. 5,314,090, the speed at which element 66 is driven is always below that necessary to throw powder material from the element 66 by centrifugal force.

The flow rate of the powder from the hopper 20 through the exit port 82 is controlled by, among other things, the rate of speed that brush 66 is rotated in the direction of arrow 67, the diameter of brush 66, the powder capacity of brush 66 and the size of the opening 24. The powder carrying capacity of brush 66 is controlled by the length and density of the bristles 80. The flow rate of powder from the hopper 20 through the feeder 60 both contribute to the over all powder flow rate to the atomizer 10.

The exit port 82 of the feeder 60 is positioned so that the powder exiting drops into the inlet 34 of the venturi 32 in the same manner as above described with regard to the positioning of the bottom opening 24 of the hopper 20 as shown in FIGS. 1–4. As shown in FIGS. 5 and 6, housing 64 may be provided in combination with pan 26 and wing 50 so as to form a common housing for both element 66 and element 28. Such a housing would extend the pan 26 upwardly to engage the hopper 62 of the material feeder 60 and the wing 50 to enclose the element 66 and to define with the pan 26 both the exit ports 34, 82 so as to segregate the elements 66, 28, and to properly define the inlet 34 and the exit 38 of the venturi 32.

In both FIGS. 5 and 6, substrate 44 can be moved either toward or away from the atomizer 10. Furthermore, the exit 38 of the atomizer 10 and the cloud of particulate material may be deflected downwardly as shown in FIGS. 5 and 6 or upwardly as desired. This choice usually depends on the particle size and particle size distribution of the cloud and whether or not it is preferable to have gravity assist in the deposition of the larger particles onto the substrate.

It is generally no concern as to the conductivity of the pan 20 and the wing 50 in the embodiment illustrated in FIGS. 5 and 6 as the embodiment is shown adapted for coating a vertically disposed substrate. Since all of the apparatus is located to one side of the surface to be coated, an agglomeration falling off the apparatus would not affect the surface coating.

In the embodiments shown in FIGS. 1–6, various variables are present in the structure. The pan 26 and the element 28 can be of any diametral size. The amount of powder that can be atomized by the atomizer 10 is greater, the larger the element 28 and pan 26, the larger the venturi 32, and the greater the volume of air into which powder can be atomized.

Whenever the element 28 is a brush, the length of the bristles becomes a variable. However, as the brush 28 rotates at speed above that speed which powder will leave the atomizer due to centrifugal force, the length of bristles is not critical.

The distance between the brush and pan however is critical and a function of the element 28 and the speed at which it travels. In a specific embodiment, this distance ranges from about 0.005 to about 0.100 of an inch The element 28 traveling at a speed sufficient to throw the particles being atomized from the element 28 by centrifugal force must be sufficient to give the air in the venturi sufficient turbulence and speed to atomize the powder into the air. Thus, the distance between the element 28 and the pan 26 can be larger if the speed of the element 28 is larger and vice versa. In specific embodiments, element 28 is preferably 2 inches or more in diameter or larger and driven at speeds from about 700 to 4,000 rpm.

The vertical distance from bottom hopper opening 24 and the venturi entrance or inlet 34 may also vary. This distance may be any distance which powder can drop and efficiently be fed to the venturi. In specific embodiments, this distance has ranged between an inch to 6 feet or more.

The radial positions between the venturi inlet 34 and the venturi outlet or exit 38 may also vary. In specific embodiments, this distance has been from about 180° to about 45°. In the embodiments illustrated in FIGS. 5 and 6, in which the atomizer 10 of the invention is combined with the material feeder of U.S. Pat. No. 5,314,090, the ratio of the diameters between the element 66 and the element 28 can be any number, in most specific embodiments, the ratio is equal to or greater than 1, similarly, the ratio of speeds is best kept as high as possible. The distance between the axes of the elements 28 and 66 measured shaft to shaft is usually just over one diameter, but may be anywhere from about a few inches to 6 feet or more.

In all of the embodiments of the invention, the powder exiting from venturi 32 follows the contour of the wing 50 and is thereby directed at a target. Powder passing through the venturi is deagglomerated, atomized, and triboelectrified if the brush bristles are non-conductive such that when it exits venturi 32, the powder is charged and particulate of the powder has a like charge. In this fashion, powder exiting from the venturi 32 is forced to disperse uniformly both transversely and longitudinally of the substrate by both the turbulent flow of the air in which the particulate is atomized and by the repellent forces of the similarly charged particles.

The particulate cloud follows the curvature of the wing 50 due to the velocity of the cloud against the wing. In specific embodiments, in which the powder atomizer is positioned from about 4 to 6 inches from a substrate, it has been observed that the particulate cloud can be directed at the substrate relatively uniformly over about a 2 to 6 inch wide pattern, uniformly both longitudinally and transversely of the substrate. At positions outside of the peripheral margins of that pattern, the uniformity in particulate concentration of the cloud falls off dramatically. The above pattern in the embodiments illustrated in FIGS. 1 and 2 where the particulate cloud is directed at a target below the atomizer where gravity works with the flow of the cloud to distribute the atomized particulate on the target, the 2 to 6 inch pattern above described may expand to about a 4 to 10 inch pattern. Similarly, when the gravitational forces on the particulate cloud oppose the movement of the particulate cloud exiting from the venturi 32 as in the embodiments illustrated in FIGS. 3 and 4, the 2 to 6 inch pattern above described may decrease to about a 1 to about 3 inch pattern.

In any event, because of this phenomena, there becomes a problem in uniformly coating vertically disposed substrates which are at distances beyond 4 to 6 inches from the atomizer of the invention. For example, uniformly coating a vertically disposed substrate 12 inches in height moving horizontally utilizing the atomizer of the invention located adjacent the lower boundary thereof would coat only about the lower 4 to 6 inches of the substrate uniformly and the powder deposition on the top 6 inches of the substrate would be significantly less than the powder deposition on the bottom 6 inches of the substrate.

Figure 7:
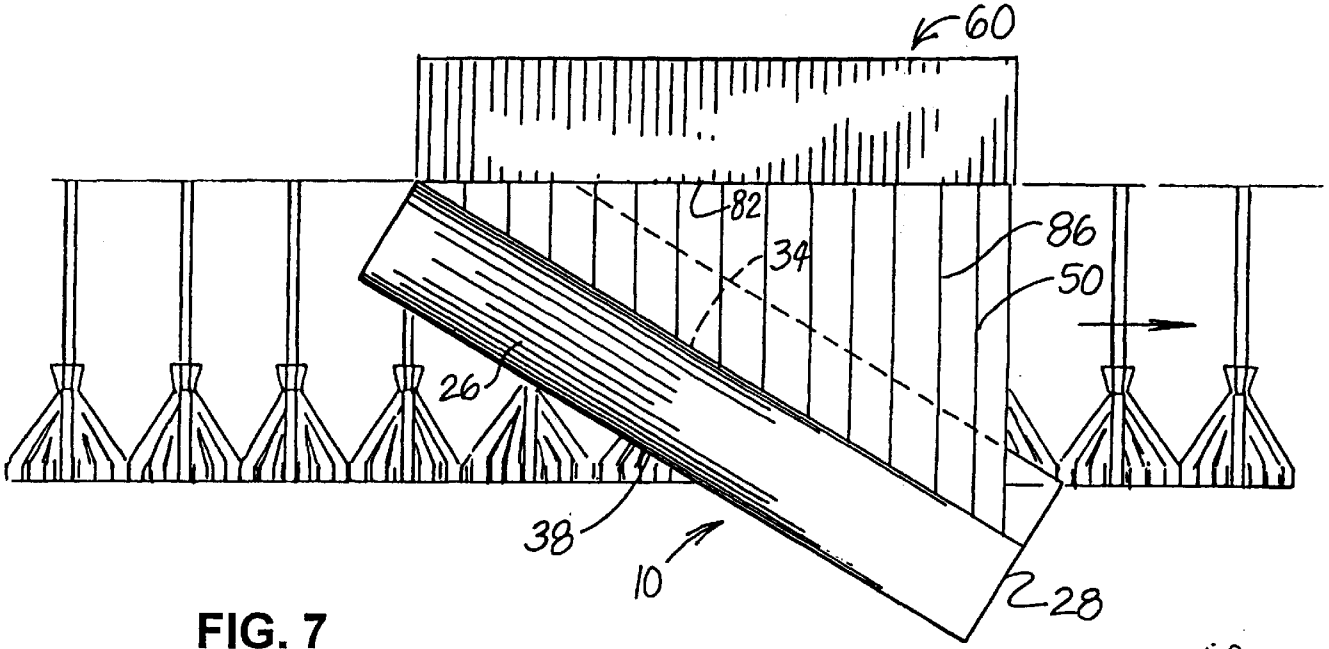
FIG. 7 is a side planar view of the powder feeder and atomizer of the invention similar to those shown in FIG. 5 for coating generally vertically disposed and generally horizontally transported substrates in which the powder atomizer is angularly disposed with respect to the substrate, the powder chute is segmented, and the wing is generally cylindrical.

Referring to FIG. 7, a powder feeder atomizer combination is shown for coating generally vertically disposed horizontally transported substrates of transverse dimensions greater than about 2 to 4 inches. As shown in FIG. 7, a powder feeder 60 having all of the structure of the powder feeder 60 above described is mounted higher than the substrate 84. Positioned beneath the feeder 60 is the atomizer 10 of the invention with the element 28 mounted in a spaced apart relationship to the substrate 84, but angularly disposed to both the vertical and horizontal as shown. A powder chute 86 extends from the bottom opening 82 to the venturi inlet 34 through which the powder drops from the powder feeder 60 to the venturi 32 formed by the pan 26 surrounding the brush element 28. The wing 50 extends from the venturi exit 38 towards the substrate 84. The wing 50 and the pan 26 and the element 28 are each uniformly spaced from the substrate 84 with the distance between the venturi exit 38 and the substrate 84, in a specific embodiment being between about 4 to about 6 inches over the entire axial length of the atomizer 10.

Inasmuch as the powder feeder 60 and the atomizer 10 can be of any axial length, the embodiment illustrated in FIG. 7 can be utilized to coat vertically disposed horizontally transported sheet material or an array of parts hanging from a vertically extending conveyor transported horizontally of any transverse or height dimension.

It is generally no concern as to the conductivity of the pan 20 and the wing 50 in the embodiment illustrated in FIG. 7 as the embodiment is shown adapted for coating vertically disposed substrate. Since all of the apparatus is located to one side of the surface to be coated, an agglomeration falling off the apparatus would not affect the surface coating.

Figure 8:
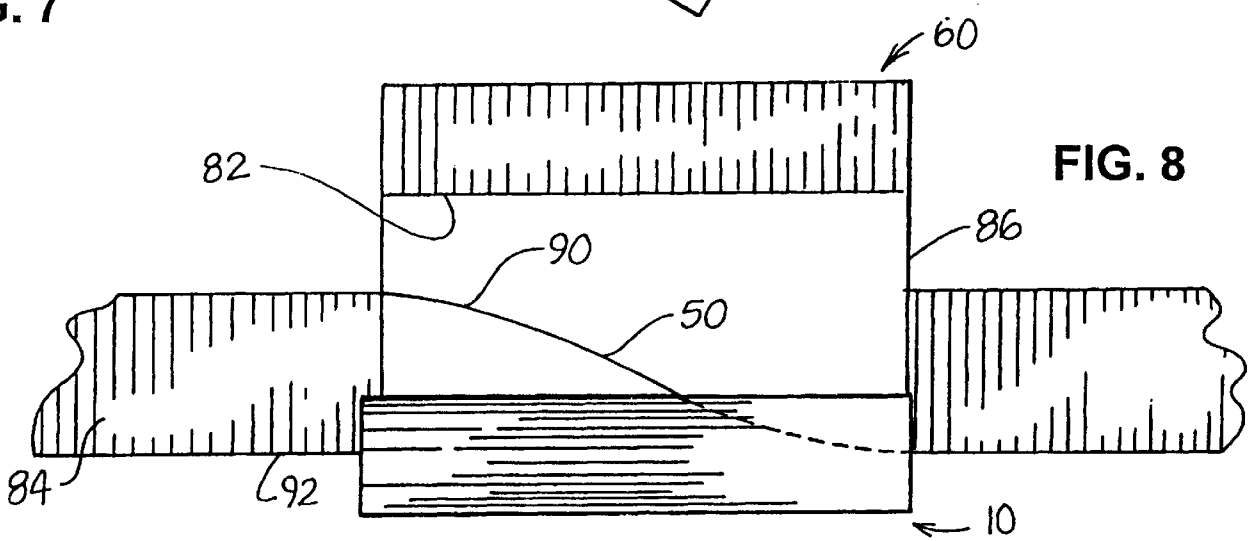
FIG. 8 is a view of an apparatus like FIG. 7 of still another version of the powder feeder and atomizer of the invention shown in FIGS. 5–7 in which the powder atomizer is generally horizontal and the substrate is generally vertical disposed and horizontally transposed, but the wing spirally extends from the atomizer upwardly.
Figure 9:
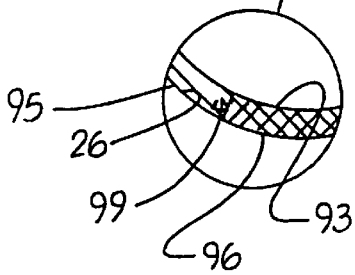
FIG. 9 is a fragmentary and perspective view of the atomizer brush and wing disassembled from the apparatus shown in FIG. 8.
Figure 9:
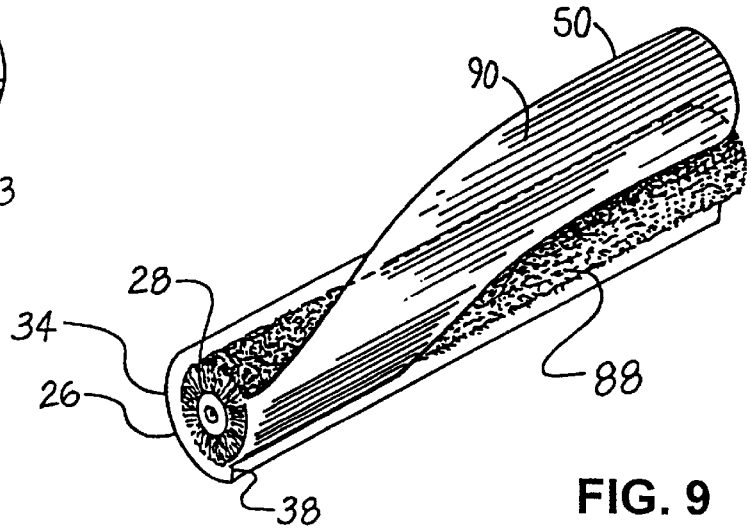

Referring to FIGS. 8 and 9, another version of the improved powder feeder atomizer deagglomerator combination of the invention is shown for use with vertically disposed and horizontally transported substrates of the type above-described. In this embodiment, the feeder 60 is shown to be positioned over the atomizer 10, a powder chute 86 extends between the exit port 82 of the feeder 60 and inlet 34 of the venturi 32, and the atomizer 10 is equipped with a wing 50 which is spirally shaped, having a spirally shaped leading edge 88 to strip the particulate cloud from the element 28, a cylindrical shape in cross-section, and a spirally shaped distal edge 90 which across its entire length is positioned from about 4 to about 6 inches from the substrate to be coated. This embodiment is useful only for substrates having transverse dimensions or a vertical height less than the vertical height of the spirally shaped wing 50 plus or minus about 1 to about 6 inches.

While in specific embodiments, the feeder 60 can be over the substrate 84 or to one side of the substrate 84, the atomizer 10 must always be located adjacent the lower edge 92 of the substrate 84 and the spirally shaped wing 50 must extend over the entire vertical dimension of the substrate 84 as shown.

FIG. 9 is a perspective view of the pan 26, brush element 28 and the spirally shaped wing 50 of the atomizer 10 illustrated in FIG. 8 to better show the shape of the wing 50 and its relationship with the venturi exit 38 and the, venturi inlet 34.

Powder chute 86 is illustrated in FIG. 7 to be a segmented chute, having spaced apart and generally parallel, generally vertical walls. In FIG. 8, chute 86 is illustrated to be an unsegmented chute, having no partitions or walls between the opposite ends. These chutes are interchangeable depending upon the dimensions of the substrate and the properties of the powder being atomized.

It is generally no concern as to the conductivity of the pan 20 and the wing 50 in the embodiment illustrated in FIGS. 8 and 9 as the embodiment is shown adapted for coating vertically disposed substrates. Since all of the apparatus is located to one side of the surface to be coated, an agglomeration falling off the apparatus would not affect the surface coating.

In operation, powder in the hopper 20 is fed through the bottom opening 24 into the inlet 34 of venturi 32 in the embodiments illustrated in FIGS. 1–4. The flow of the powder into the venturi 32 may be controlled by selectively choosing bottom opening 24 to be of a specific size or controlling the action of vibrator 22. As the powder enters the venturi 32, the element 28 draws carrier gas through the venturi at a relatively fast speed in a turbulent manner. Element 28 atomizes all of the powder coming in contact with the element as element 28 is being rotated at a speed in excess of that necessary to throw the powder therefrom by centrifugal force. Depending upon the particulate material and the rigidity of the bristles 80 of the element 28, the particulate size also may be reduced in the atomizer 10 by varying the speed of the brush, as desired. Powder dispersed in the carrier gas in the form of a cloud is exited from venturi exit 38. This cloud is generally homogeneous in the amount of powder per unit of volume of carrier gas, but also in particle size distribution, and in particle distribution both in the direction of gas flow and in directions transverse thereof. Furthermore, particle size distribution is generally uniform throughout the cloud as the turbulence of the carrier gas within the venturi is sufficient to deagglomerate the powder. In any event, by the proper choice of element speed, powder of relatively uniform size can be relatively uniformly distributed throughout the cloud in both particle density and particle size distribution.

Very little mechanical work is done on the powder employing the aspirator 10 of the invention by the element 28 or gravitational forces. When the powder feeder 60 is utilized with the aspirator 10 of the invention, precise amounts of powder may be metered into the aspirator 10. By controlling the flow of powder from the hopper 62 into the feeder by conventional means and controlling the speed of the element 66, precisely measured amounts of powder can be fed into the aspirator 10. Vibration and gravity move the powder from the hopper 62 into the element 66 which carries the powder to the exit port 82 with very little mechanical work done on the powder. In the specific embodiments in which the element is a brush, the powder is fed into the bristles 80, the brush rotates and releases the powder by gravity through exit port 82. Therefore by selecting a vibration rate (if a vibrator 22 is used), a housing having an exit opening 24 of a specific size, a brush 66 and a rotational speed, precise amounts of powder can be delivered to the aspirator 10 of the invention.

As the brush element 66 rotates, the element is exposed to the powder in hopper 62 and is filled with powder between the bristles and is rotated over exit port 82 through which the element 66 discharges the powder carried by the element. Once the powder is discharged from the powder feeder 18 or 60 into the aspirator 10, powder enters the venturi 32 by the venturi inlet 34 and is engaged with fast moving carrier gas drawn through the venturi by the element 28. Element 28 throws all of the powder into the carrier gas by centrifugal force and moves the carrier gas in a turbulent fashion through the venturi 32 towards the venturi exit 38. Once the powder leaves the venturi exit 38, the uniform particulate cloud follows the curvature of the element 28 until it is stripped from the element 28 by the wing 50, and is guided by the wing 50 in accordance with conventional gas flow principles towards the entrance 46 of the coating machine 48. As shown in FIGS. 1 and 2, the cloud from the exit 38 can be directed downwardly by the aspirator 10 of the invention to coat the top side of the substrate. As shown in FIGS. 3 and 4 the aspirator 10 may direct the particulate cloud from the venturi exit 38 upwardly so as to coat the bottom side of a substrate. Substrates can be coated on both sides, whether orientated horizontally or vertically as shown in FIGS. 1–4, FIGS. 5 and 6 and FIGS. 7–9, respectively.

The powder throughput of the atomizer 10 of the invention in all embodiments is controlled by the rate of powder being fed into the venturi 32 by the powder feeder 20 or 60. The particulate density of the cloud generated by the atomizer 10 of the invention is a function of the amount of powder fed into the atomizer 10 and the amount of carrier gas drawn through the venturi. In most practical applications, the amount of carrier gas drawn through the venturi is controlled by the distance between pan 26 and element 28 and the speed of rotation of the element 28. The smaller the distance the less carrier gas, the larger the distance the more carrier gas. Similarly, the amount of powder fed into the venturi 32 by the powder feeder is primarily, in the case of hopper 20, a function of the size of the bottom opening 24 and the flow of powder therethrough, or in the case of feeder 60, the speed of rotation and capacity of the element 66.

The improved atomizer of the invention produces a relatively uniform cloud of particulate material and directs that cloud into a electrostatic coater either in an upwardly direction or a downwardly direction as desired. By the invention, an improved powder atomizer and an improved powder feeder atomizer combination and an improved powder feeder atomizer deagglomerator combination is provided for all powder coating operations.

The improved powder atomizer of the invention is particularly useful for wide web coating operations as it can produce clouds of relatively uniform size particulate material in cross-sections taken longitudinally of the web and transversely thereof which can be highly uniform both in particulate size and particulate size distribution. By utilizing a particulate feeder such as disclosed in U.S. Pat. No. 5,314,090, highly accurately metered amounts of particulate material can be atomized and placed upon substrates of any transverse dimension, whether disposed horizontally, vertically or at an angle therebetween by the improved atomizer, feeder atomizer combinations and feeder atomizer deagglomerator combinations of the invention.

The improved powder atomizer, improved powder feeder atomizer combination and powder feeder atomizer deagglomerator of the invention can be utilized to coat both the top and bottom sides of horizontally disposed webs and both sides of vertically disposed webs. The improved powder atomizer, feeder atomizer and feeder atomizer deagglomerator of the invention can be utilized to feed powder coating apparatus at a reasonable installation and maintenance cost. Finally, the improved atomizer, feeder atomizer and feeder atomizer deagglomerator of the invention can be provided in a form which has all of the above desired features.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A powder atomizer, comprising a pan, an element journaled for rotation about an axis, said pan partially surrounding said element and therewith defining a venturi into which powder is fed, said venturi having an inlet into which powder is fed and a spaced outlet, a motor rotating said element within said pan in excess of the speed required to throw powder from said element by centrifugal force and drawing gas through said venturi so that powder fed into said inlet is atomized and produces a uniform cloud of particulate material, and means minimizing the electrical charge on said pan and thereby the resulting agglomeration of particulate material at said outlet.

2. A powder atomizer, comprising a pan, a cylindrical element journaled for rotation about an axis, said pan being coaxial of and partially surrounding said element for therewith defining a venturi into which powder is fed, said venturi having an inlet and a radially spaced outlet, a motor rotating said element in excess of the speed required to throw powder from said element by centrifugal force and drawing gas through said venturi for thereby atomizing powder fed into said inlet to produce a uniform cloud of particulate material, and said pan adjacent to said outlet comprising a nonconductive material.

3. The atomizer of claim 2 wherein said nonconductive material has a conductivity of from about $10^{10}$ to about $10^{16}$ ohm centimeters.

4. The atomizer of claim 2 wherein said nonconductive material is chosen from the group consisting of structural polymeric materials.

5. The atomizer of claim 2 wherein said nonconductive material is chosen from the group consisting of polycarbonates, acrylics, acetals and polyethylenes.

6. The atomizer of claim 2 wherein said pan adjacent said outlet is pointed, thereby defining an edge adjacent said element, and said pan having a surface depending from said edge.

7. The atomizer of claim 6 wherein said surface depending from said edge is generally perpendicular.

8. The atomizer of claim 2 wherein said pan is made of nonconductive material from said outlet to at least the lowest point of said venturi.

9. The atomizer of claim 1 or 2, further comprising a wing spaced from said element, said wing having a surface extending upwardly away from said element, said surface being aerodynamically smooth and having an angle with respect to the horizontal, said wing having an end surface spaced from said element having an angle with respect to the horizontal surface greater than the angle of repose and said wing having a backside surface having an angle with respect to the horizontal greater than the angle of repose.

10. The atomizer of claim 9 wherein said nonconductive material of said wing has a conductivity from about $10^{10}$ to about $10^{16}$ ohm centimeters.

11. The atomizer of claim 9, wherein said angle of said aerodynamically smooth surface and said backside surface is less than 90°, said aerodynamically smooth surface is shaped to direct the cloud away from said element, and further comprising a target spaced from said wing, said aerodynamically smooth surface directing the cloud toward said target.

12. The atomizer of claim 9 wherein said angle of said aerodynamically smooth surface is less than 90°.

13. The atomizer of claim 9 wherein said angle of said surface spaced from said element is about 90°.

14. The atomizer of claim 9 wherein said angle of said backside surface causes any powder accumulation thereon to fall from said wing toward said element.

15. The atomizer of claim 9 wherein said angle of said backside surface is from about 45° to about 70°.

16. The atomizer of claim 9 wherein said angle of said aerodynamically smooth surface is from about 45° to about 70°.

17. The atomizer of claim 9 wherein said wing has a cylindrically shaped surface adjacent to said element.

18. The atomizer of claim 11 wherein said target is elongated, said element and pan are parallel to the elongation of said target, said wing having edges which are spirally shaped so as to extend the full transverse width of said target.

19. The atomizer of claim 11 wherein said target is elongated, and said element, pan and wing extend transversely of said target.

20. The atomizer of claim 11 wherein said target is radially displaced from said inlet from about 45° to about 240°.

21. The atomizer of claim 1, wherein:

said element is a cylindrical brush.

22. The atomizer of claim 1, wherein:

said means minimizing the electrical charge extends outwardly from said pan.

23. The atomizer of claim 22, wherein:

said means minimizing the electrical charge forms a portion of said venturi.

24. The atomizer of claim 23, wherein:

said means minimizing the electrical charge terminates below said axis.

25. The atomizer of claim 24, wherein:

said axis is disposed intermediate said inlet and said outlet.

26. The atomizer of claim 1, wherein:

said means minimizing the electrical charge is formed from a material selected from the group consisting of polycarbonates, acrylics, acetals, and polyethylenes.

27. The atomizer of claim 1, further comprising:

a powder hopper having an outlet, said hopper outlet communicating with said inlet.

28. The atomizer of claim 1, wherein said means minimizing the electrical charge is bonded to said pan.

29. A powder atomizer comprising a pan, a cylindrical element, said element being journaled for rotation about an axis, said pan being cylindrical and positioned coaxial of said element, said pan partially surrounding said element, said element and pan defining a cylindrical venturi therebetween into which powder is fed, said venturi having an inlet and outlet radially spaced apart, means for rotating said element within said pan at speeds in excess of the speed required to throw powder from said element by centrifugal force, said element drawing gas through said venturi and atomizing powder fed into said inlet to produce a uniform cloud of particulate material, said element being chosen to maximize particle to particle and particle to element collisions thereby to deagglomerate and reduce the particle size of the powder being fed into said venturi.

30. The atomizer of claim 29 wherein said element is a brush having bristles, said bristles being chosen with a transverse dimension and length and physical properties together with the physical properties of the powder being fed to said venturi to deagglomerate and reduce the particle size of said powder.

31. The atomizer of claim 30 wherein the bristles of said brush are resilient, said bristles resiliently flex upon collision between said bristles and said particles, thereby increasing the deagglomeration and reduction in particle size of said powder.

32. The atomizer of claim 30 wherein the bristles are chosen from the group consisting of natural fiber bristles, synthetic polymer bristles, and metallic bristles.

33. The atomizer of claim 30 wherein the transverse dimension of said bristles ranges from twice the size of said particulate material to about 50 times the size of said particulate material.

34. The atomizer of claim 30 wherein said bristles have a transverse dimension ranging from about 0.001 inch to about 0.062 inch.

35. The atomizer of claim 30 wherein said bristles have a length to transverse dimension ratio of from about 10 to 1 to about 5,000 to 1.

36. The atomizer of claim 30 wherein said bristles have a dimension in the direction of rotation ranging from about 0.001 inch to about 0.062 inch.

37. The atomizer of claim 29 wherein said bristles are essentially cylindrical having a length to diameter ratio from about 10 to 1 to about 5,000 to 1.

38. The atomizer of claim 29 wherein said bristles are generally the shape of a parallelogram in cross-section and wherein said bristles have a transverse length to longitudinal length ratio from about 200 to 1 to about 800 to 1.

39. The atomizer of claim 29 wherein said bristles have a parallelogram cross-section which in the direction of rotation the bristles are thicker than in directions transverse thereto and said bristles having more rigidity and less flexibility in the direction of rotation than in directions transverse thereto.

40. The atomizer of claim 29 wherein said bristles have a length of from about one half inch to about 5 inches.

41. The atomizer of claim 29 wherein said pan and element both have a length to diameter ratio greater than 1.

42. The atomizer of claim 29 further comprising a wing spaced from said element from about 0.001 to about 0.20 inches and further comprising a target spaced from said wing from about 1 to about 6 inches toward which said cloud is directed.

43. The atomizer of claim 42 wherein said target is elongated and said element and pan are angularly disposed to said target.

44. The atomizer of claim 42 wherein said wing is cylindrically shaped in cross-section.

45. The atomizer of claim 42 wherein said wing has an aerodynamic surface thereon, said surface being planar.

46. The atomizer of claim 42 wherein said target is elongated, said element and pan are parallel to the elongation of said target, and said wing has edges which are spirally shaped so as to extend the full transverse width of said target.

47. The atomizer of claim 29 wherein said bristles have a dimension transverse to the direction of rotation ranging from about 0.001 inch to about 0.062 inch.

48. The atomizer of claim 29 wherein said bristles have a bristle length to transverse dimension ratio ranging from about 200 to 1 to about 800 to 1.

49. The atomizer of claim 1, or 2, or 29, wherein said inlet is diverging.

50. The atomizer of claim 1, or 2, or 29, wherein said outlet is diverging.

51. The atomizer of claim 1, or 2, or 29, wherein said element is rotated at a speed of from about 700 to about 4,000 RPM.

52. The atomizer of claim 1, or 2, or 29, wherein said venturi has a uniform thickness between said inlet and said outlet of from about 0.001 to about 0.020 inches.

53. The atomizer of claim 1, or 2, or 29, wherein said element has a diameter greater than about 2 inches.

54. The atomizer of claim 1, or 2, or 29, wherein said powder ranges in size from about 2 to about 300 microns.

55. The atomizer of claim 1, or 2, or 29, wherein said element is a brush.

56. The atomizer of claim 1, or 2, or 29, wherein said powder being fed into said venturi has a size larger than the particulate material exiting said venturi.

57. The atomizer of claim 1, or 2, or 29, wherein said powder is chosen from the group consisting of thermoses and thermoplastic organic polymers, organic materials, and combinations thereof.

58. The atomizer of claim 1, or 2, or 29, wherein said cloud is a relatively uniformly triboelectrified cloud of particulates.

* * * * *